United States Patent [19]

Stark

[11] Patent Number: 4,994,707

[45] Date of Patent: Feb. 19, 1991

[54] VIBRATION-RESISTANT SINGLE-ENDED HALOGEN INCANDESCENT LAMP

[75] Inventor: Roland Stark, Wellheim, Fed. Rep. of Germany

[73] Assignee: Patent-Treuhand Gesellschaft für elektrische Glülampen m.b.H., Munich, Fed. Rep. of Germany

[21] Appl. No.: 405,518

[22] Filed: Sep. 11, 1989

[30] Foreign Application Priority Data

Sep. 22, 1988 [DE] Fed. Rep. of Germany ... 8812010[U]
Sep. 22, 1988 [DE] Fed. Rep. of Germany ... 8812009[U]
Sep. 22, 1988 [DE] Fed. Rep. of Germany ... 8812011[U]

[51] Int. Cl.[5] ..... H01K 1/18

[52] U.S. Cl. ..... 313/269; 313/271; 313/279; 313/579

[58] Field of Search ..... 313/269, 279, 271, 579

[56] References Cited

U.S. PATENT DOCUMENTS 2,863,082 12/1958 Lamb ..... 313/279 X
3,898,505 8/1975 Danko ..... 313/279 X
3,982,145 9/1976 Lipton ..... 313/279 X
4,529,908 7/1985 Jacrot ..... 313/579
4,876,482 10/1989 Stadler ..... 313/271 X

FOREIGN PATENT DOCUMENTS 6804136 4/1969 Fed. Rep. of Germany .
7310947 9/1973 Fed. Rep. of Germany .

*Primary Examiner*—Palmer C. DeMeo
*Attorney, Agent, or Firm*—Frishauf, Holtz, Goodman & Woodward

[57] ABSTRACT

To reliably retain a filament (13) axially aligned in a bulb (2) of a halogen incandescent lamp, a first current supply lead (8) is shaped to engage the inner wall (14) of the bulb at spaced corners or bend points (16, 21, 22, 424), the corner or bend points being connected by connecting legs (17, 18, 425). The legs and corner points can be arranged in triangular configuration (FIGS. 1–3; FIGS. 10–13) or in cross shape (FIGS. 4–9), and the remote end (15) of the filament, weld or push-connected to the connecting legs or end portions of the current supply lead. The polygonal corner and bend point engagement with the inner wall of the tube provides for substantially improved resistance against vibration of the filament; the engagement of the first corner or bend point, which bends the upper portion of the current supply lead towards the interior of the bulb and towards the filament, upon vibration, results in axial deflection, thereby maintaining the filament in axial position and preventing lateral excursion.

42 Claims, 11 Drawing Sheets

VIBRATION-RESISTANT SINGLE-ENDED HALOGEN INCANDESCENT LAMP

Reference to related patents, the disclosure of which is hereby incorporated by reference:

U.S. 3,898,504, Danko

U.S. 3,982,145, Liptow

U.S. 4,876,482, Stadler, assigned to the assignee of the present application

Reference to related publications:

German Utility Model GM 68 04 136

German Utility Model GM 73 10 947.

FIELD OF THE INVENTION

The present invention relates to a single-ended halogen incandescent lamp, and more particularly to a construction which renders the lamp more resistant to vibration and shock, and permits maintenance of the filament of the lamp in a predetermined position, so that the lamp is particularly suitable for association with a reflector, or to carry, itself, reflecting coatings.

BACKGROUND

Single-ended halogen incandescent lamps have, usually, a cylindrical bulb of transparent material, a base, and an axially extending coiled incandescent filament. The filament extends from a base end to a remote end, and is held in position by a filament mount which is coupled, electrically and mechanically, to the respective ends of the filament. The filament mount is retained in position in the lamp by a cross bar of non-conductive material, typically quartz, or a similar material. Two internal current supply leads pass through the cross bar and are retained in position thereby, the internal current supply leads and the cross bar together forming a filament mount assembly. One of the current supply leads extends along the inner wall of the bulb towards the remote end of the filament to provide an electrical connection therefor and possibly also to hold it in position. The other of the current supply leads is connected to the base end of the filament. The current supply leads which extend outwardly from the cross bar are connected to a standard connection arrangement which, for example, is formed by molybdenum foils, connected to external current supply leads, the molybdenum foils being held in the bulb by a pinch or press seal.

Halogen incandescent lamps of this type are suitable for operating voltages in the range of about 50 V to 250 V, and can be constructed with nominal power ratings of, for example, between about 40 W to 150 W.

It has been proposed to determine the position of the current supply lead which extends to the remote end of the filament, which will also be referred to as the first current supply lead, by securing it in, or on an exhaust tip formed at the remote end of the bulb (see, for example, German Utility Model DE-GM 68 04 136). Such a construction is expensive and difficult to make, and extends the overall length of the lamp. It is difficult to produce such lamps, particularly under mass production conditions. Difficulties arise upon fitting of the filament in the mount and when flushing the lamp and cleaning it; exact centering of the filament in the lamp axis is difficult to obtain, yet such centering is desirable for applications where reflection of radiation from the filament is of importance.

Some lamps have been proposed in which the first current supply lead connected to the remote end of the filament is bent, with its free end, in circular form, which is tightly engaged against the inner wall of the glass bulb, see for example U.S. Pat. No. 3,898,505, Danko (assigned General Electric). This arrangement improves the centricity of the filament, but requires precise manufacture of the loop to engage the wall. This loop must be somewhat springy to account for tolerances in the bulb. The springiness of the loop, which is considerable, will be transferred in the form of vibrations and oscillations to the filament if the lamp is retained in an unstable socket or fitting (see U.S. Pat. No. 3,982,145, Liptow, discussed below).

Circular loops to maintain a filament in position have also been proposed for lamps of the "Lumiline" type, which are double-ended lamps having an elongated filament. The filament is supported along the length of the lamp by several circular loops (see for example U.S. Pat. No. 3,982,145, Liptow, assigned General Electric). As an alternative to circular loops, the elongated filament can also be held in position in central loops which are placed within polygons, preferably seven-cornered polygons. It is very difficult to make such holders.

The German Utility Model Publication DE-GM 73 10 947 describes a holder for such elongated lamp filaments which engages the wall of the lamp at three points. The arrangement, in effect, is similar to a triangle within a circle. The filament is held from one of the sides of the triangle, which, rather than being one straight line, is formed of two radially directed leg portions. Alternatively, a part-circular loop, extending spirally towards the center, can be used in order to hold the filament. This holder, like the previous elongated lamp types, requires that the filament is threaded through a central holding portion of the holder structures. This is difficult to carry out in practice. The arrangement, further, will transfer vibration and shock forces affecting the filament to the holder structures. Upon being subjected to shock, the filament may shift substantially from the central or quiescent position, which changes the angular relationships of the triangle.

Holders for "Lumiline" or elongated type double-ended lamps are used to prevent sag of the very long filament structure, particularly if the lamp is operated in horizontal position. Such sag interferes with proper operation of the halogen incandescent lamp.

Single-ended halogen incandescent lamps have filaments which are substantially shorter than those of the double-ended lamp type. It is usually not necessary to provide extensive support systems for the filament to prevent sagging thereof in operation. On the other hand, however, the holder which at the same time also forms the current supply must unambiguously and reliably determine the position of the filament, for example the axial position thereof coaxial with the axis of the lamp. At the base end, this is simple since the associated current supply lead is fixed in position in the press seal and extends only a short distance therebeyond. To support the remote end of the filament in position, however, is much more difficult since it is supported and supplied by current from the free end of the first or internally extending current supply lead, which extends in parallel to the filament within the bulb itself.

THE INVENTION

It is an object to provide a lamp construction for a single-ended halogen incandescent lamp in which particularly the remote end of the filament is so held that the filament is tensioned, as well as being precisely axially centered, even under conditions of shock and vibration. In effect, the position of the filament should be exactly determined so it cannot be deflected from its predetermined, typically coaxial position within the lamp.

Briefly, the first current supply lead, that is the one which holds the remote end of the filament, is positioned so that it is at least in part in contact with the inner wall of the bulb. At about the level of the remote end of the filament, the first current supply lead is bent at a first corner or bend point towards the interior of the bulb generally within a plane parallel to or including the axis of the filament, so that the current supply lead will extend away from the wall. The current supply lead is further formed with at least two more spaced corners, to form at least second and third spaced corner or bend points. These corner or bend points are connected by connecting legs; a first connecting leg is located between the first and the second corners or bend points; a second connecting leg is connected between the second and third corner or bend points. A further portion of the current supply lead may be connected to the remote end of the filament, for example close to the axis of the lamp and, preferably, offset therefrom by the radius of the coiling of the filament or the filament can be secured to a connecting leg. All the corners or bend points are in engagement with the inner wall of the bulb, so that the first current supply lead is retained at engagement points with the inner wall of the bulb, thereby providing a rigid structure.

In accordance with a feature of the invention, the first connecting lead is bent to have generally the shape of a T, in which the first leg between the first and second corners extends essentially diametrically across the bulb, and then is angled, for example at an essentially right angle, towards the inner surface of the bulb where it will engage the bulb at the second corner or bend point, to be then bent, essentially parallel to the angled portion to extend to a point at the inner end of the bulb opposite the diametrically extending leg portion, the second leg forming the cross bar of the T.

In accordance with another feature of the invention, the first supply lead, beyond the first corner or bend point, is bent in the shape, essentially, of an equilateral triangle, having one open end or open side. A terminal portion of the current supply lead extends from the third corner point towards the axis of the lamp and is then bent axially downwardly towards the base, to form a small extending tip to which the remote end of the filament can be secured. The equilateral triangle need not start at the first bend point but, rather, the lead beyond the first bend or corner can extend inwardly in essentially diametrical direction across the bulb to form an inwardly extending portion from which a lateral portion extends, towards the second bend point, and defining one side of the triangle.

In accordance with another feature of the invention, the remote end of said first current supply lead is formed with four corner or bend points, and is bent to be, in top or plan view, essentially cruciform, having two cross elements, each with two corner or bend points, all four of which are in engagement with the inner wall of the bulb.

The connecting legs or portions of the first current supply lead beyond the first corner or bend point can all be in a single plane, for example extending diametrically across the bulb, e. g. perpendicularly to an axis of the bulb; they may, however, also be located, in whole or in part, in a plane which is inclined with respect to the axis of the lamp. The remote end of the filament of the lamp can be connected to the free end of the first connecting lead, or to a portion thereof, for example one of the connecting legs, or to one connecting leg portion, which extends essentially diametrically across the axis of the lamp. A tiny plate or leaf of platinum may be inserted between the end of the filament and the current supply lead to facilitate making the electrical and mechanical connection between the filament and the first current supply lead.

The lamp, in accordance with the invention, has the advantage that production is substantially simplified. Evacuation of the bulb, and filling of the bulb with a lamp fill, is substantially easier than with prior art constructions, since engagement of the current supply lead with the pump or exhaust tip is not required. Additionally, and as a further important advantage, the inner length of the bulb and therefore the overall length of the lamp can be reduced, so that a higher fill pressure can be used. Typically, this reduction of the inner length is about 10% conventional lamps have an inner length of 30 mm which can be reduced by 3 mm. The filament is better centered than in prior art structures, and is accurately held in center position and less subject to deflection under shock or vibration. This is particularly important if the bulb is coated with an infrared (IR) coating to provide for back-reflection of IR radiation to the filament, thereby increasing the operating efficiency of the lamp and reducing energy consumption for a given light output.

The filament for the lamp, in accordance with the present invention, preferably is a coiled-coil filament in which the end portions are axially offset. Such coiled-coil filaments can be made easier, cheaper, and more accurately than coiled-coil filaments having centrally extending end portions. The mount of the present invention is formed in such a way that both an easy connection of the ends of this type of filament is given and at the same time a rigid structure of the mount is ensured. This also increases, indirectly, the accuracy with which the position of the filament can be placed in the axis of the lamp. Instead of threading of the filament on an end it is in some embodiments easily possible to weld the terminal ends of the filament to the current supply leads, especially to a connecting leg of the first supply lead. The terminal ends of the current supply leads need not be in the central axis of the filament, and hence of the lamp.

The mount suitable for the welding technique has another advantage: The very same mount can be used for lamps of different power ratings, for example in the range of between 40 to 130W. Such lamps have filaments of different dimensions. The remote end of the current supply lead can be connected as desired to filaments of any coiling diameter, and it is only necessary to appropriately connect the base end of the filament to the second connecting lead, for example by welding the base end of the filament to the second connecting lead which has in similar way a 90° angled terminal end for connecting filaments of any diameter.

DETAILED DESCRIPTION

Figure 1:
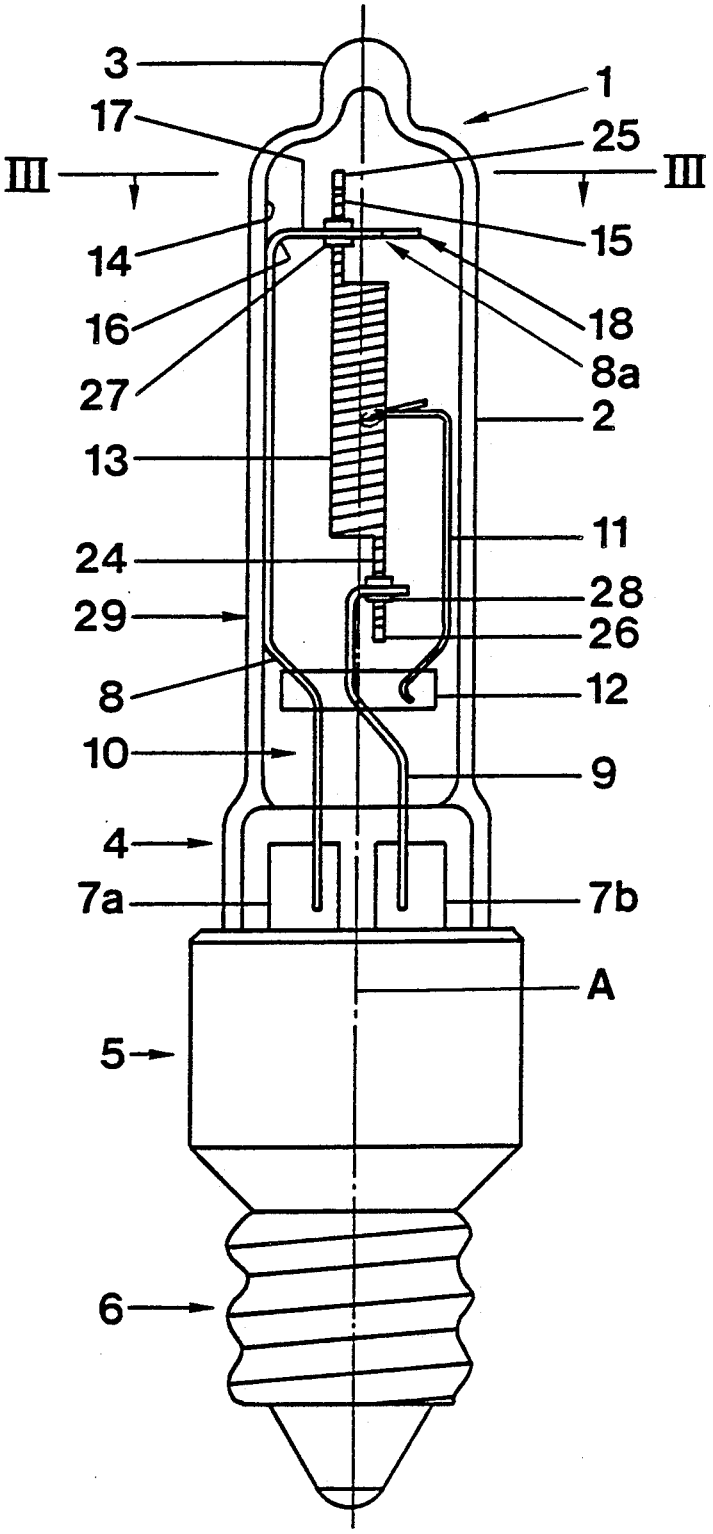
FIG. 1 is a schematic side view of a halogen incandescent lamp.
Figure 2:
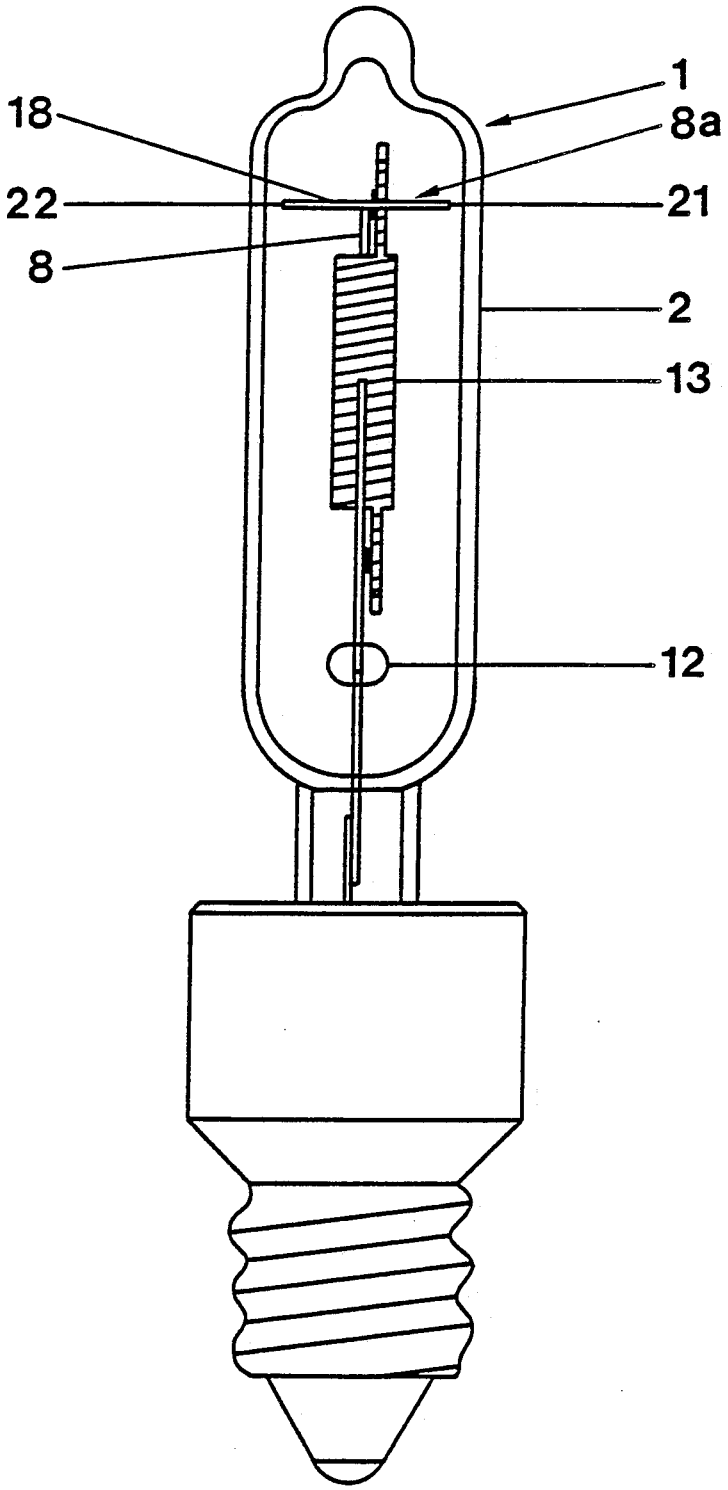
FIG. 2 is a front view of the lamp of FIG. 1, rotated by 90° with respect to FIG. 1.
Figure 3:
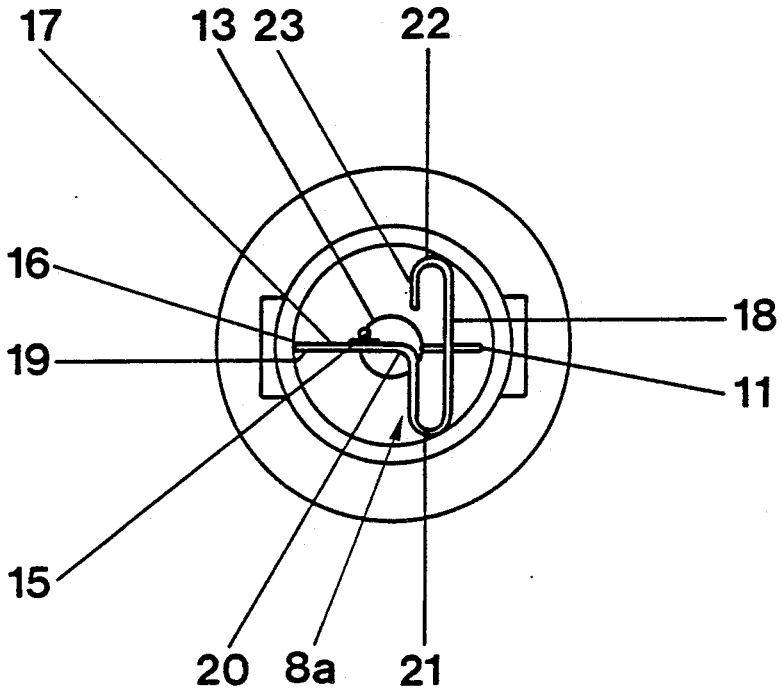
FIG. 3 is a top view of the lamp of FIG. 1, looking downwardly in the plane III—III of FIG. 1.

Referring first to FIGS. 1-3:

The side views and front views of FIGS. 1 and 2 illustrate a halogen incandescent lamp 1, designed for 110 V operation, having a rated power of 130 W. The lamp 1 has a cylindrical bulb 2 of quartz glass, formed at one end with an exhaust tip 3 at the dome thereof. It is filled with an inert gas, for example 80% Kr, and 20% $N_2$, with an additive of about 0.2% HBr, forming a halogen compound. The end at the dome is termed the remote end; the base end of the bulb 2 is closed off by a pinch or press seal 4 and connected to a ceramic base 5 having an external Edison thread 6 which, at least in part, is metallic and secured by a cement to the ceramic base 5. Two molybdenum foils 7*a*, 7*b* are sealed in the press seal 4. The molybdenum foils 7*a*, 7*b* are electrically connected to external current supply leads—not visible since hidden by the base—and connected to the thread 6 and an external central current supply button, as well known in the lamp manufacturing field. The molybdenum foils 7*a*, 7*b* are connected to two inwardly directed or inner current supply leads 8 and 9, the molybdenum foils forming electrically conductive, but vacuum-tight connections. The two inner current supply leads which, each, are formed by a single, unitary tungsten wire having a diameter of about 0.34 mm, are part of a lamp mount 10. The lamp mount 10 further includes a support wire 11. The lamp mount 10, also, includes a cross element, in form of a cross beam 12, of quartz glass. The cross beam 12 holds the first current supply lead 8 and the second current supply lead 9, as well as the support wire 11 in position. The entire lamp mount, with the exception of the remote end region 8*a* of the first current supply lead 8 is located in a single plane which is intersected by the lamp axis A; further, the mount is vertically arranged in a plane through which the lamp axis passes.

The filament is a coiled-coil or double-coiled element 13 having a primary coiling of, for example, 0.42 mm outer diameter and a secondary coiling with an outer diameter of, for example, about 2.7 mm. The filament extends axially and is located, retained and maintained in position by the elements extending from the filament mount 10, namely the first and second current supply leads 8, 9 and the support wire 11.

A 45 W lamp can be similarly constructed, except that the filament will have a primary winding of 0.35 mm outer diameter and a secondary winding or coiling of 1.8 mm outer diameter. The mount for the filament can be identical to that of a 130 W lamp.

The support wire 11 is melt-connected to the cross beam or cross element 12 and electrically insulated from the current supply leads, so that it is free from voltage. It extends parallel to the filament 13 up to about a central or median portion thereof and is then hooked to a winding of the filament in a known manner.

The second current supply lead 9, starting from the molybdenum foil 7*b*, extends to the quartz cross beam 12. It is slightly laterally offset or bent, and then extends in axial direction from the cross beam 12 up to the single-coil end portion 24 of the filament. Close to the end portion 24, it is bent in a 90° bend to extend transversely across the lamp for a short distance, see FIG. 1.

The first current supply 8, secured to the molybdenum foil 7*a*, extends in axial direction to the cross element 12, and is there melt-connected therein. The first current supply lead 8 offset or bent towards the inner wall surface 14 of the bulb 2.

In accordance with a feature of the invention, the first current supply lead 8 extends parallel to the inner wall surface 14 of the lamp up to about the level of the remote end 15 of the filament structure 13. At that position, the first current supply lead 8 is bent with a first bend of e.g. 90° towards the axis A of the lamp. This forms a first corner or bend point 16, in engagement with the inner wall 14 of the lamp. The current supply lead portion at the remote end is bent in a plane transversely to the axis A of the filament to form, generally, the shape of a T which is apparent from FIG. 3.

As seen in FIG. 3, and in accordance with a feature of the invention, the first current supply lead 8 forms a first connecting leg 17, starting at the end 19 close to the corner or bend 16, and extending to the cross bar of the T, shown generally at 18 in FIG. 3. The first connecting leg 17 is coupled at its base end 19 with the corner or bend 16 of the current supply lead 8. Preferably, the current supply lead 8 is a unitary element, but it need not be. At the head end 20 of the first connecting leg 17, it is bent in a plane transversely to the lamp axis A towards the second bend point 21 which is the first end point of the cross element 18 of the T. At that point 21, the current supply lead 8 is bent backward upon itself by 180°. The cross element 18, which forms a second connecting leg, extends up to a third corner or bend point 22, beyond which the current supply lead 8 terminates in a free end portion 23. The bend 22 and the free end portion 23 are provided to protect the inner surface of the wall of the bulb. The end portion 23 is bent back upon the cross element 18 by about 180°, towards the axis of the lamp.

The length of the first connecting leg 17 is about 80% to 90% of the length of the cross element 18 which forms a second connecting leg. The lengths of the first connecting leg and of the cross element 18, or second connecting leg, are so selected that, besides the corner 16 at the end 19 of the first leg 17, the second and third corner or bend points 21, 22 of the second connecting leg engage the inner wall surface 14 of the bulb. The length of the first connecting leg 17 is longer than the inner radius of the bulb 2, so that the first connecting leg 17 forms a tangent to or passes through the axis A of the lamp.

The three-point engagement of the remote region of the current supply lead 8 provides for centrally maintaining that section or region of the current supply lead 8 within the lamp, accurately centered therein.

Assembly of the lamp:

The coiled-coil filament 13 is axially aligned. The end portions 15, 24 are only singly coiled, and offset by the radius of the secondary winding from the lamp axis. They extend in parallel to the lamp axis, the end portions 15,24 being, however, laterally offset in opposite directions with respect to the lamp axis, as is clearly seen in FIG. 1. The base end portion 24 is to the right of the lamp axis A, the remote end portion 15 to the left of the lamp axis A. The end portions 15, 24 of the filament 13 have pins 25, 26 made from tungsten inserted into the coiled winding. The pins 25, 26 fit within the inner diameter of the first coiling or winding of the end portions 15, 24, respectively of the filament.

The remote end 15 of the filament crosses the first connecting leg 17 of the first current supply lead 8. The base end 24 of the filament crosses the bent-over end of the second current supply lead 9. A thin platinum leaf or tiny platinum plate 27, 28, respectively, is inserted at the cross points of the filament ends and the respective current supply leads.

An infrared reflective coating 29 is vapor-deposited at the outer wall surface of the bulb 2.

The respective wire portions of the mount are first bent, typically in the shape shown in FIG. 1, and melted into the cross beam 12 of quartz, so that the relative position of the current supply leads 8, 9 and support wire 11 are fixed.

The filament is then inserted into a welding die holder. The mount, pre-bent and positioned by the beam element 12 and placed in the die, and the ends of the filament, with the platinum leaves interposed, are welded together. The platinum plates or leaf elements and the inner pins 25, 26 assist in making a secure weld.

It is also possible to make the mount of molybdenum wire. If molybdenum is used, it is not necessary to use platinum plates.

The fixed mount, with the filament secured thereto, is then inserted into the lamp bulb which is still open at the bottom. The bulb is then heated in the region of the pinch or press seal; the pinch seal is formed. Upon formation of the pinch or press seal, the base end of the filament is fixed in position in the bulb; the remote end of the filament is automatically centered and fixed in position by the three-point engagement at the corner or bend points of the first connecting lead 8. The bulb is then gas filled via the exhaust tube and tipped off in a known manner.

The mount structure in accordance with the present invention permits substantial reduction of deflection of the filament from the axis of the lamp, under conditions of shock, vibration, incorrect mounting or the like, when compared with known and prior art structures.

Measures were made with a 130 W lamp, having an inner bulb diameter of about 1 cm, and using tungsten wire of 0.340 mm diameter for the current supply leads. In a vibration test, the filament deflected from the lamp axis A with the three-point engagement arrangement a maximum of 0.25 mm. A lamp with a known holding structure, in which the entire mount is bent only in a single plane, and in which, for example, the remote end was bent in roof shape or the like, as shown for example in the referenced U.S. Patent Stadler, based on application Ser. No. 07/272,214, resulted in the maximum deflections of the filament, under identical vibration conditions, of 1 mm. Other prior art structures were worse.

The mount structure in accordance with the present invention improves centering of the filament in a single-ended halogen incandescent lamp by a factor of 4. This results in substantially increased efficiency of operation because the infrared reflective coating will re-heat the filament by re-directing the emitted IR radiation, after reflection, back towards the lamp axis, and hence back towards the filament, the filament being, even under vibration, retained essentially within the lamp axis.

The structure can be used for various types of lamps, and various voltages, for example for network voltages of 220–250 V. The voltage can readily be lowered, for example to a network voltage of 110 V and the effective voltage can be dropped to 84 V by serially connecting a diode with one of the current supply leads, for example located and integrated in the base.

The connecting portions 17, 18 of the filament mount at the remote end of the lamp are preferably located in a plane extending transversely to the axis A of the lamp. This is not a requirement, however, and as will appear, the three-point suspension could also be obtained in a plane which is inclined with respect to the axis A of the lamp.

The connecting legs 17, 18 of the mount structure are reliably retained within the bulb 2. This is clearly apparent when one considers FIG. 3. By connecting the remote end of the filament 15 to the first connecting leg, forming the trunk of the T, deflection of the filament from the normal axial position is effectively reduced. The trunk of the T, that is, the first connecting leg 17, to which the remote end of the filament is connected, will vibrate upon shocks or vibrations, that is, a tendency to change the angle of the bend, only along the axis of the lamp. Any vibrations of the trunk are damped by the engagement of the second or third corner or bend points at the inner wall of the lamp. The first corner or bend point 16, upon vibration, will tend to cause deflection of the end section of the first current supply lead only up and down—with respect to FIG. 1—so that the filament will be retained within the lamp axis. It is possible that the position of the second connecting leg, forming the cross element of T, can change relative to its position to the trunk or first connecting leg 17 of the T, by change of the angle between the first connecting leg 17 and the cross element 18. This change, however, does not have any effect on the filament end 15 which is secured to the first connecting leg or trunk 17 of the T. This arrangement, thus, is particularly effective in reducing excursion of the filament from axis A upon shock or vibration being imparted to the lamp.

Three corners or bend points are all that is necessary to provide a stable remote portion or section or region 8*a* for the first connecting lead 8. Other configurations, with more than three engagement points against the inner wall of the lamp may also be used and, for example, a generally cruciform arrangement is suitable. This arrangement, for some applications, may have manufacturing advantages, in that welding the filament to one of the connecting legs can be predetermined more easily.

Referring to FIGS. 4–7:

The lamp shown in FIGS. 4 and 5, again, is a 110 V halogen incandescent lamp of 130 W. Elements similar to those previously described have been given the same reference numerals and will not be described again.

Their construction and operative embodiment is similar to that previously described.

Figure 6:
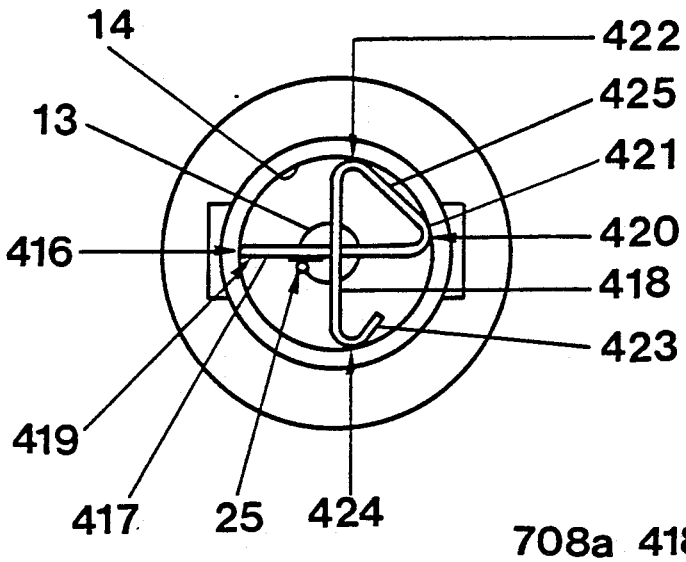
FIG. 6 is a top view of the lamp, taking downwardly, along line VI—VI of FIG. 4.
Figure 4:
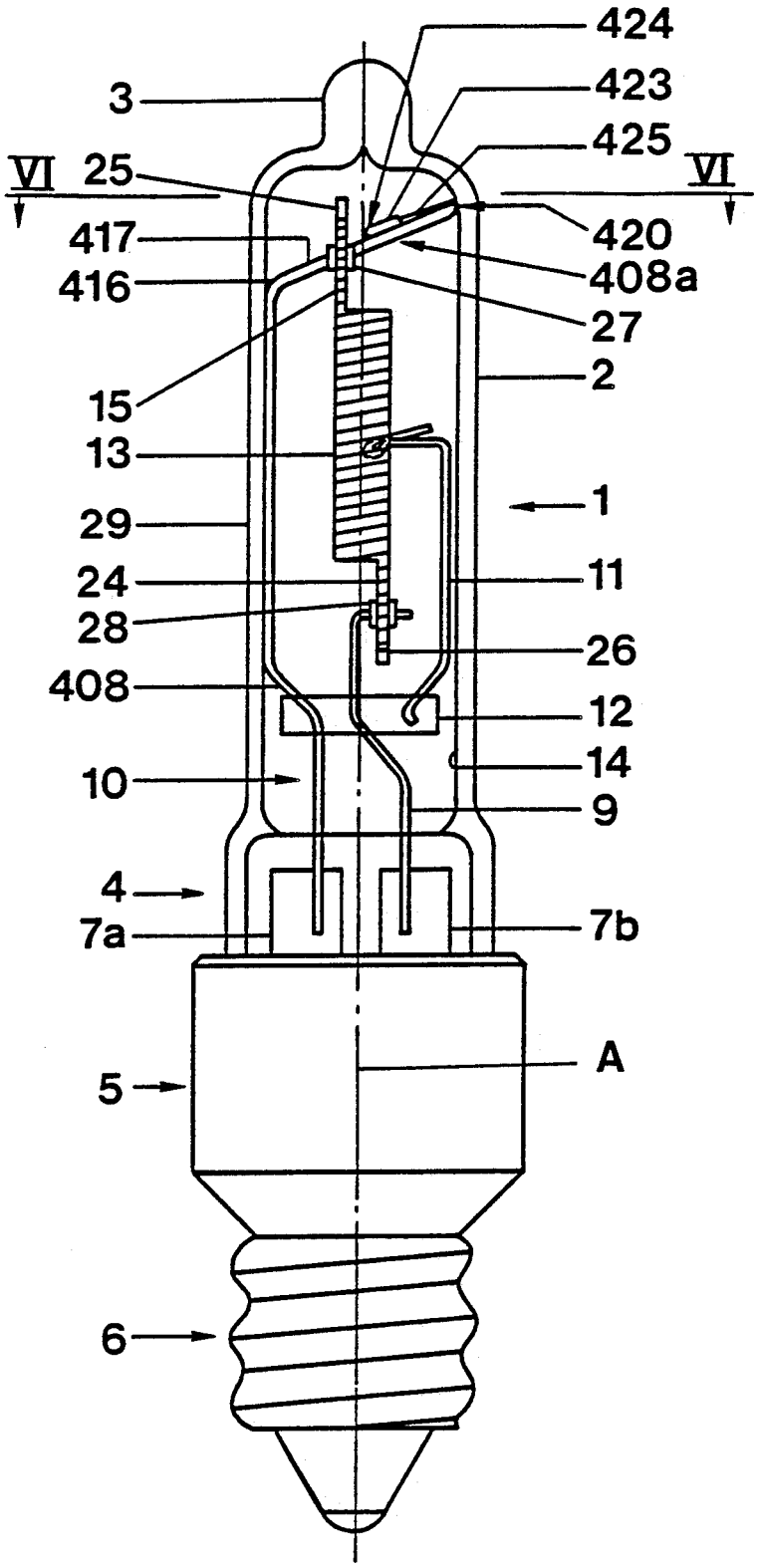
FIG. 4 is a side view of a lamp, similar to FIG. 1, and showing another embodiment.

The first connecting lead 408 is bent at the first connecting point 416 at an angle of about 65° with respect to the lamp axis A. The bent-over portion 408*a* forms a first leg 417 which is tangent to the lamp axis and extends towards the opposite inner wall of the bulb 2. In top view, as best seen in FIG. 6, the connecting first leg 417 forms the trunk of a cross. The trunk as well as the cross beam 418 of the cross, actually, are in one plane, as best seen in FIG. 4. The normal of this plane is located in the plane of the remaining mount. This angled construction is preferred because it allows easy insertion of the mount into the bulb.

The initial or foot end part 419 of the trunk 417 follows immediately after the bend 416. The opposite end of the trunk, namely the head 420 thereof, engages at point 21 the inner surface 14 of the wall of the bulb 2. A connecting leg 425 connects the second corner or bend point 421 adjacent the head 420 of the trunk with a third corner or bend point 422. The connecting leg 425 forms an angle of about 45° with respect to the trunk 417 as well as with respect to the cross beam 418. The cross beam 418, thus, crosses the trunk 417 in the center, or at least approximately in the center, of the lamp axis. Both the trunk as well as the cross element may have essentially the same length. The cross element 418, suitably, is only loosely placed on the trunk 417, so that it is supported thereby. The overall resiliency or springiness of the cross construction is not interfered with by the crossing of the cross element 418 over the trunk 417.

The cross element 418 extends essentially diametrically across the lamp axis towards a diametrically opposite fourth corner or bend point 424. The first current supply lead is then bent inwardly towards itself to form an end portion 423. It is bent backwardly by about 135°, so that the corner or bend point will be rounded and, therefore, the inner wall surface 14 of the lamp will not be engaged by a projecting tip. All four corner or bend points 416, 421, 422, 424 form the four end points of a cross, all engaging the inner wall 14 of the bulb, and all forming bends to protect the inner wall.

The four-point engagement provides for reliable positioning of the remote end 15 of the filament, centrally, within the bulb.

The remote end 15 of the filament 13 crosses the trunk 417 of the remote portion 408*a* of the first current supply lead 408. Thin platinum foils 27, 28 assist in welding the filament to the current supply leads.

When assembling the lamp, the lamp mount together with the end portion 408*a*, is placed into a die; preferably, the plane in which the cruciform end portion 408*a* is located is positioned at an inclination with respect to the lamp axis, as shown in FIG. 4. Upon subsequently pinch-sealing the base end of the bulb, the base end of the mount is fixed, together with the filament; the remote end is automatically centered and positioned in the bulb by the four-point engagement of the mount-and-filament assembly within the inner wall of the bulb.

For some structures it is desirable to locate the plane in which the remote end of the first filament is located transversely to the axis of the lamp, as shown in FIGS. 1 and 2. In this configuration, welding may be easier. Depending on the exact arrangement and sizes involved, sometimes, the inclined construction may be preferred (FIGS. 4 and 5) for the reason of easy insertion or the perpendicular construction (FIGS. 1 and 2) for the reason of easy welding.

The resistance of the filament with respect to vibration of the structure using four corners or bend points for engagement against the inner wall of the lamp is at least as good as that of the three-point structure of FIGS. 1–3.

Various changes can be made in the cruciform arrangement; for example, rather than using the symmetrical arrangement illustrated in FIG. 6, a non-symmetrical arrangement can be used in which the cross element 418 is shorter than the trunk element 417, and crosses the trunk element offset from the axis A of the lamp. Further, the pin 25 within the filament end 15 at the remote end can terminate flush with the filament end 15, and need not extend thereover, as shown in FIG. 4.

Figure 7:
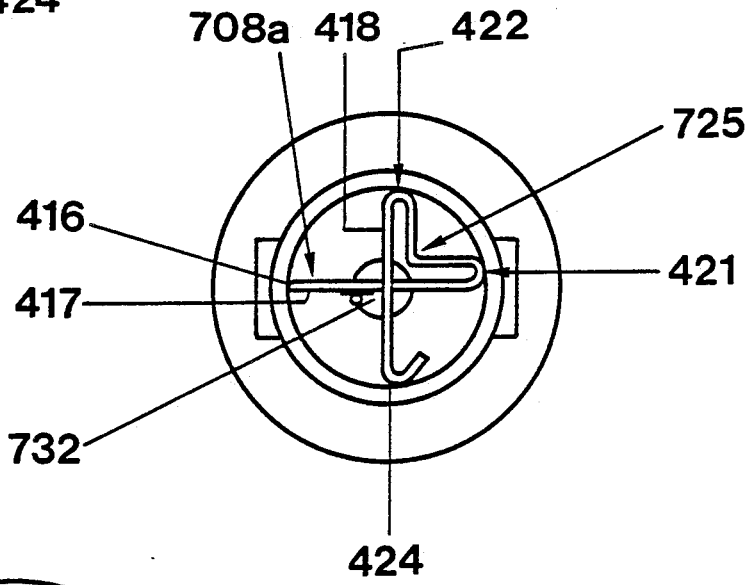
FIG. 7 is a top view of a lamp illustrating another embodiment of the bent end zone of the first current supply lead, and similar to FIG. 6.

The connecting portion 425 of the generally cruciform arrangement can be constructed differently. FIG. 7 illustrates an arrangement in which a connecting portion 725 connects the bends 420 and 422. The end portion 708*a* of the connecting lead thus extends from the bend 416 beyond a theoretical center point 732 to the second bend 420. At that point, the second connecting leg 725 is bent with respect to the trunk 417 back upon itself, for about 180°, and then again bent at a right angle to the third corner or bend point 422. The second connecting leg 725, thus, is an angle element. This structure has the advantage that shadowing of light is reduced since the interfering portion 425 is replaced by the portion 725 which is close to the existing elements 417 and 418.

Figure 9:
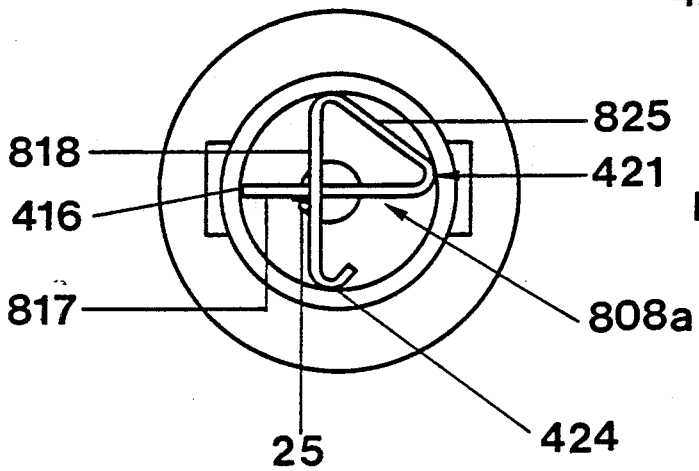
FIG. 9 is a top view of the lamp of FIG. 8 taken along line IX—IX of FIG. 8.
Figure 8:
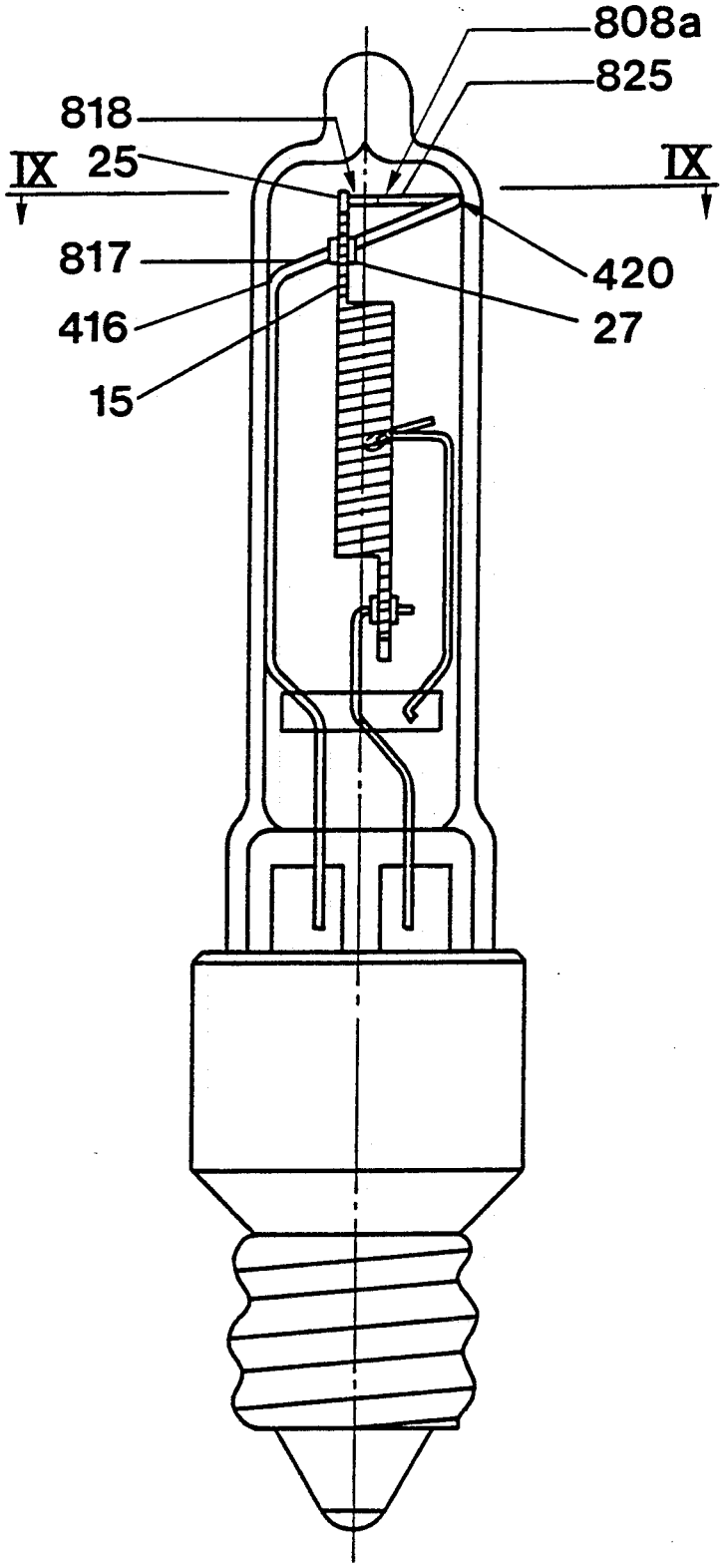
FIG. 8 illustrates another embodiment of the invention, in side view.

FIGS. 8 and 9 illustrate an arrangement in which the cross element 418 is replaced by element 818 which is located in a plane transversely to the axis of the lamp and locate at the height of the second bend 420, whereas, the trunk 817 extends at an angle of 65° between first bend 416 and second bend 420. The connecting element 825 which is similar to 425 and, if desired, may also have a shape similar to the connecting element 725, is also located in the same transverse plane. In this arrangement, the remote end 15 of the filament is connected to the trunk 817 with the interposition of a platinum plate 27. The inner pin 25, within the coiled filament, is extended upwardly and welded to the cross element 818. This provides for particularly good stabilization of the remote portion 808*a* of the filament mount. This arrangement is particularly suitable for lamps which are subjected to particularly high shocks or vibration. The additional weld connection to the cross element is made only after the mount has been placed into the bulb 2, for example by means of a laser weld, in order to consider tolerances in the inner diameter of the lamp bulb, and to precisely locate the filament in axial position. The trunk portion 817 as well as the cross portion 818 of the cruciform arrangement are in different planes; in top view (see FIG. 9), the cruciform shape of the end portion 808*a* is retained.

The remote portion 8*a* of the first current supply lead 8 (FIGS. 1–3) was arranged in a T shape, and forming three corner or bend points which engage the inner wall of the bulb 2. In this embodiment, the filament ends were welded to the current supply leads.

Another embodiment, which allows threading the filament ends on the current supply leads without, however, sacrificing the advantages of corner engagement, typically three corners is also possible.

Figure 12:
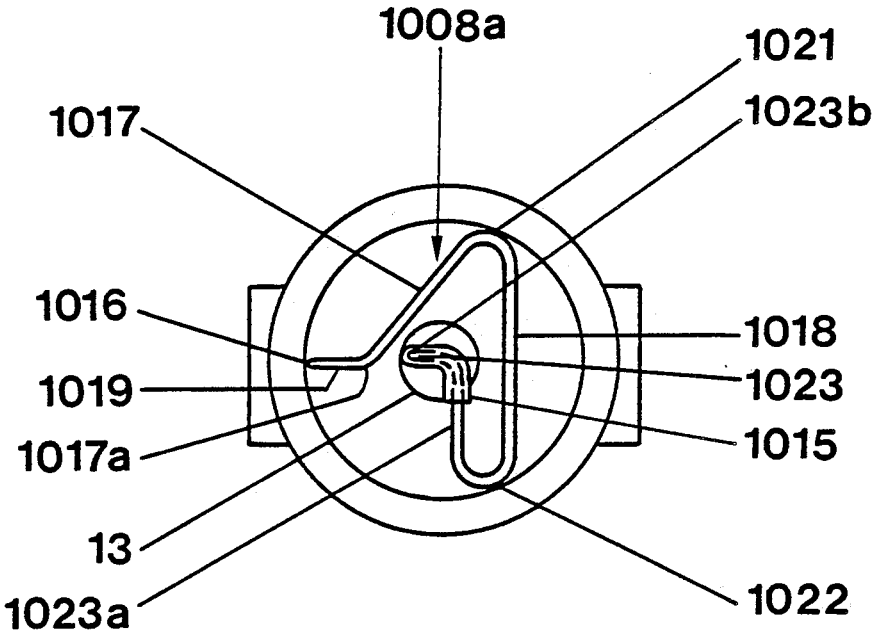
FIG. 12 is a top view taken along line XII—XII of FIG. 10.
Figure 10:
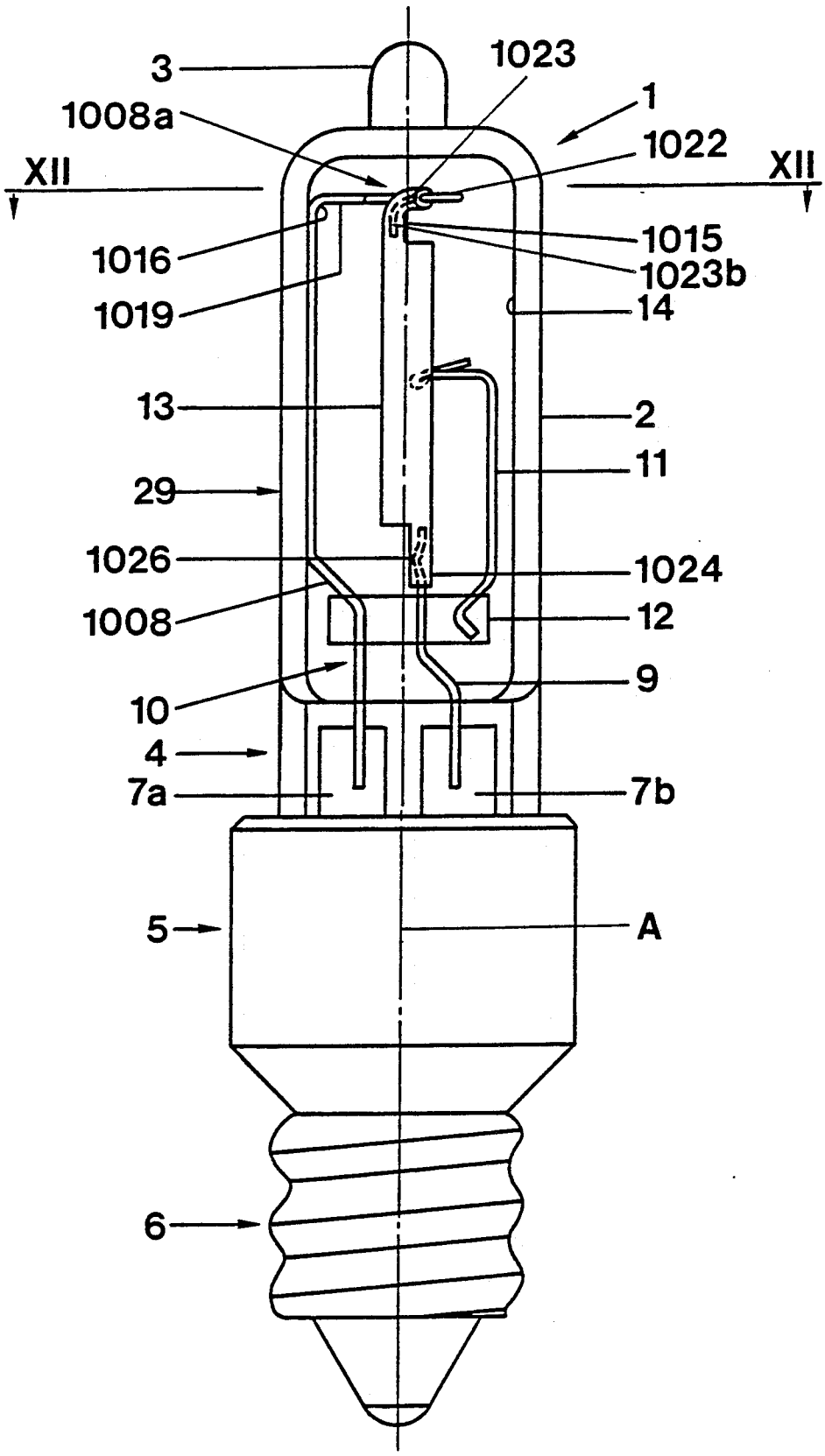
FIG. 10 is a side view of a halogen lamp, illustrating yet another embodiment.
Figure 11:
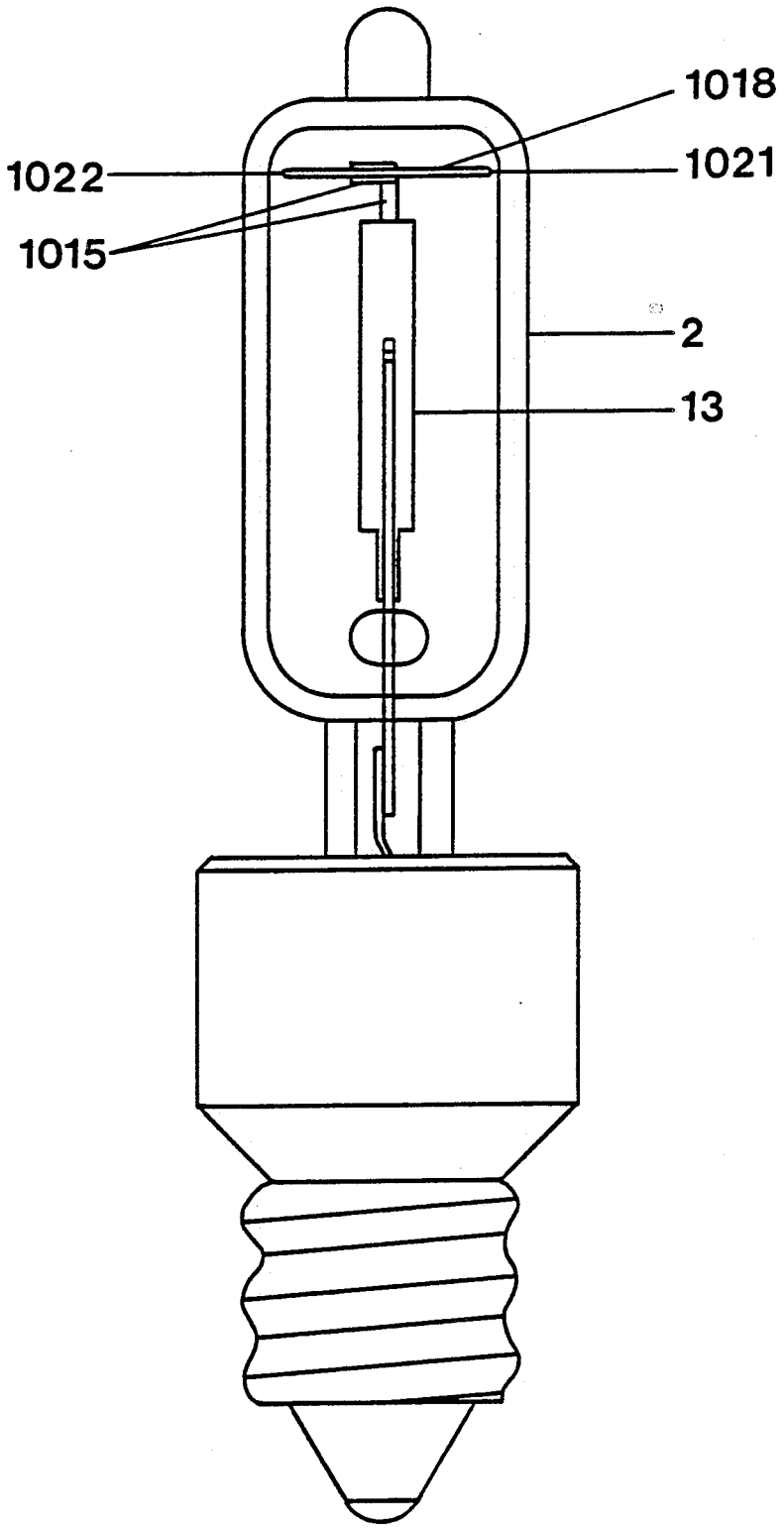
FIG. 11 is a front view of the lamp of FIG. 10, and rotated by 90° with respect to FIG. 10.
Figure 5:
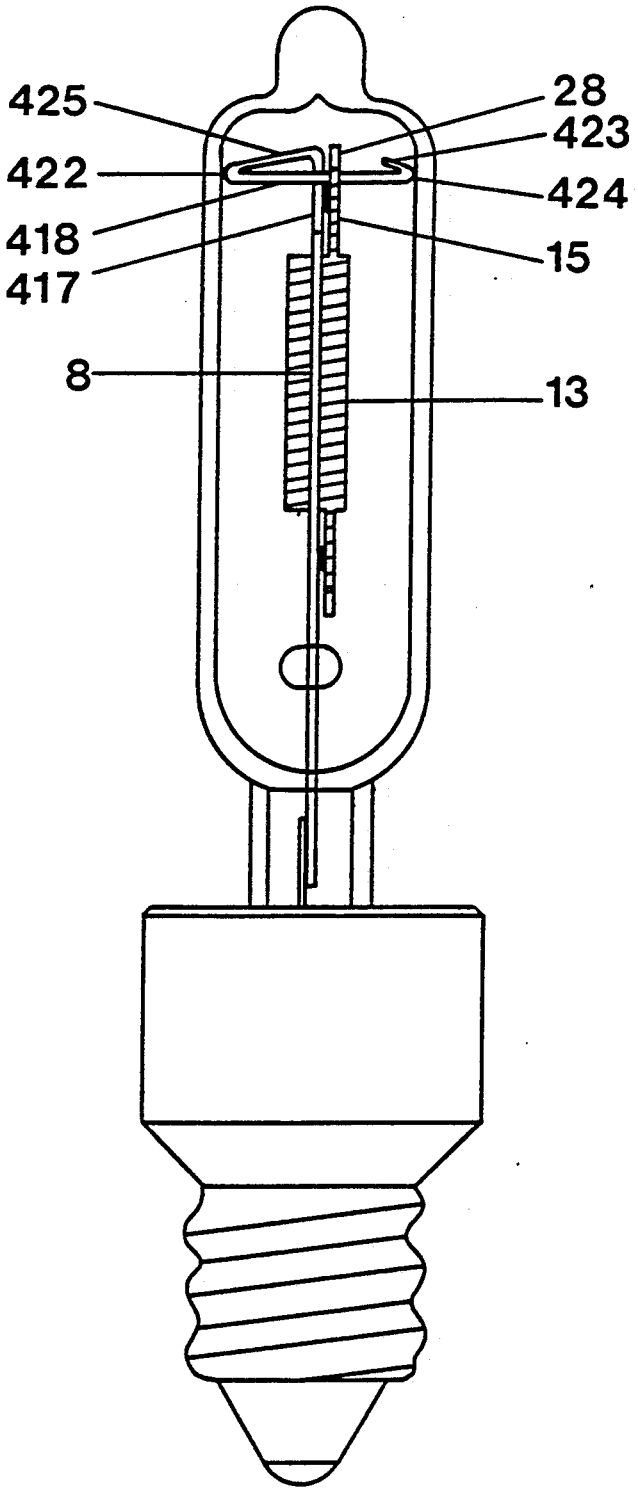
FIG. 5 is a front view of the lamp of FIG. 4, rotated by 90° with respect to FIG. 4.

Referring now to FIGS. 10–12, and illustrating this embodiment of the invention, in which, again, the same reference numerals have been used for similar elements:

The remote end 1008*a* of the current supply lead 1008 is bent at the first bend or corner point 1016 in a plane transverse to the axis A of the lamp, although it could be bent in a plane at an angle of inclination as well; the end portion 1008*a* is then additionally bent in approximately the shape of an equilateral or an isosoeles triangle within this plane.

Referring specifically to FIG. 12, the end portion 1008*a* extends from the first bend or corner 1016 approximately diametrically inwardly for a short distance to form a short diametric portion 1019, until it meets another bend point 1017*a*, from which the end portion 1008*a* extends laterally with respect to the axis of the lamp. A first connecting leg 1017 will thus be formed, starting at the lateral bend 1017*a* extending towards the second bend or corner 1021 to form a second connecting leg 1018. The second connecting leg 1018 forms the base of the isosceles triangle, which has the tip or end point 1017*a*, second corner or bend point 1021 and third corner or bend point 1022. The base 1018 extends transversely to the plane of the mount 10 including the first current supply lead 1008. One of the sides 1017 extends between the tip 1017*a* of the isosceles triangle and the corner 1021 which it forms with the base thereof.

The second side of the triangle is not bent towards the tip 1017*a* thereof but, rather, it is open. The free end 1023*a* is bent by a 180° bend at the third corner or bend point 1022 inwardly up to approximately the position of the lamp axis.

End 1023*a* does not exactly meet the lamp axis, however, but rather is laterally offset with respect thereto. At the level of the lamp axis, the free end is bent by about 90° in the plane of the triangle towards the lamp axis and extends, beyond the lamp axis, in the direction of the first, straight portion 1019 of the end portion 1008*a* of the mount. The straight part 1023, extends in the same direction as the portion 1019.

The terminal end portion 1023*b* of the part 1023, at about the level of the remote end 1015 of the filament 13, is bent at a right angle in the direction of the filament 13—see FIG. 10. It terminates, parallel to the lamp axis A, a few millimeters downwardly from the plane of the end portion 1008*a* of the current supply lead 1008. The remote end 1015 of the filament 13 which is laterally offset with respect to the lamp axis, as explained above, is threaded on the free end 1023*b* of the current supply lead 1008. In order to provide for a particularly reliable attachment of the filament, it is additionally threaded over the section 1023 and part of the section 1023*a*, incorporating two 90° bends, as described above.

The second, inner current supply lead 9 is secured, as before, to the quartz cross element 12 and then extends straight towards the base end of the filament 1024. The single-coiled end portion of the filament is threaded on the current supply lead 9. To ensure reliable holding of the filament on the current supply lead 9, the current supply lead 9 is formed with a shallow undulation 1026.

The coil-coiled filament 13, placed in axial direction, has only single coiled ends 1015 and 1024. Both are offset by the radius of the secondary winding or coiling from the lamp axis A, in opposite directions. The end zones of the respective current supply leads 9 and 1008 are suitably positioned to meet this offset.

Assembly of the lamp in accordance with FIGS. 10–12 is similar to that previously described, except that the current supply leads 1008 and 9 are not welded to the filament ends but, rather, the filament ends are pushed over the respective end portion of the current supply leads, and engaged around the bends or undulations thereof, respectively.

Three-point engagement and holding of the upper part 1008*a* of the first current supply lead 1008 is obtained again by the bend 1016 and the bend or corner points 1021 and 1022.

Resistance to vibration of a lamp in accordance with the embodiment of FIGS. 10–12 is as good as that of the other embodiments.

Figure 13:
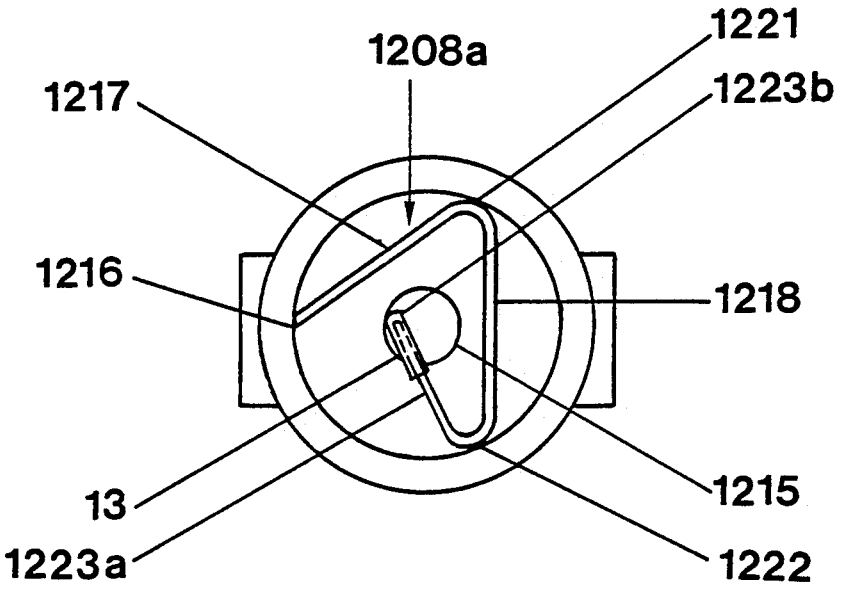
FIG. 13 is an illustration similar to FIG. 12, and illustrates a modified shape of the first current supply lead.

The triangular configuration illustrated in FIG. 12 is not the only one which can be used; the triangle could also be an equilateral triangle, eliminating the connecting part 1019, so that the tip of the triangle will coincide with the bend 1216 (FIG. 13). The triangle is built up by the bend points 1216, 1221 and 1222, which are connected by the legs 1217 and 1218. The third side of the triangle is open as described above.

The free end of the lead 1208*a*, coming from the third corner point 1222, forms the leg 1223*a*, which extends to the bend 1223*b* directly, merely requiring a slightly more open bend at the third bend point 1222. The bend 1223*b* (corresponding to bend 1023*b* of FIG. 12) bends the lead part 1208*a* at a right angle in the direction of the filament 13. The filament end 1215 is threaded over the bend 1223*b* up to the leg 1223*a*. This arrangement is easier to make since one bend is eliminated; the filament 13, however, is not retained as securely as when it is threaded or pushed over two bends, and thus is not as taut.

Various changes and modifications may be made, and any features referred to in connection with any one of the embodiments may be used with any of the others. Rather than using tungsten wires, molybdenum wires can be used throughout.

I claim:

1. A single-ended halogen incandescent lamp (1) having
   - a cylindrical bulb (2) of transparent material;
   - a base (5);
   - an axially extending coiled incandescent filament (13) defining an axis and further defining a base end (24) and a remote end (15);
   - a filament mount (10) connected to and coupled to the respective ends (15, 24) of the filament and including
     - a cross bar (12) of non-conductive material; and
     - two internal current supply leads (8, 9) passing through the cross bar and being retained in position thereby,
     - one (8) of said current supply leads extending parallel to the axis (A) of the lamp towards the remote end of the filament and there defining an upper portion (8*a*),
     - the other (9) of said current supply leads extending towards the base end of the filament and being connected thereto; and
   - a press seal (4) securing the mount (10) in the bulb,
   - wherein a first corner or bend point (16) located in a vertical plane parallel to the axis of the filament is formed in said one current supply lead (8), said first bend point being located at about the level of the remote end of the filament, and extending said one current supply lead away from the wall in said plane;
   - said upper portion (8*a*) extends beyond said first corner or bend point (16) inwardly of said bulb (2);

said one current supply lead being further formed with at least one second and third spaced corner or bend point (21, 22);

a first connecting leg (17) located between the first corner or bend point (16) and the second corner or bend point (21);

a second connecting leg (18) located between the second corner or bend point (21) and the third corner or bend point (22);

wherein all of said corner or bend points (16, 21, 22) are in engagement with the inner wall (14) of the bulb (2); and wherein the remote end (15) of the filament (13) is secured to said upper portion (8*a*) of said one current supply lead (8) in a region thereof beyond said first corner or bend point (16).

2. The lamp of claim 1, wherein said upper portion (8*a*), in plan view taken transversely to the axis (A) of the lamp, is generally T shaped, in which the first connecting leg (17) forms the trunk of the T, said second connecting leg (18) forms the cross bar of the T, the base of the trunk starting at said first corner or bend point (16) and the end points of the cross bar (18) forming the second and third bend points.

3. The lamp of claim 2, wherein the trunk (17) of the T is connected to said first current supply lead (8) at the first corner or bend point (16).

4. The lamp of claim 3, wherein the trunk (17) of the T at the end thereof remote from said first corner or bend point is bent at an approximately 90° angle extending transversely to the trunk towards a first end point of the cross element (18) of the T and being connected thereto by said second corner or bend point (21), said second corner or bend point forming a 180° bend.

5. The lamp of claim 4, wherein the second end point (22 of the cross bar of the T, and forming said second connecting leg (18), terminates in a free end (23).

6. The lamp of claim 5, wherein said free end (23) is a backwardly bent portion of said upper portion (8*a*) to form a rounded, bend corner at said third corner or bend point (22) for engagement with the inner wall of the bulb.

7. The lamp of claim 1, wherein the remote end (15) of the filament extends parallel to the axis (A) of the lamp, and is offset with respect thereto.

8. The lamp of claim 1, wherein both ends (15, 24) of the filament extend in the direction parallel to the axis (A) of the lamp, and are offset with respect thereto.

9. The lamp of claim 1, wherein said one current supply lead (8) is in engagement with the inner wall (14) of said bulb (2).

10. The lamp of claim 1, further including a weld connection connecting at least one end (15, 24) of the filament (13) with a respective one of said internal current supply leads.

11. The lamp of claim 10, further including a platinum leaf or plate (28) positioned between the respective ends (15, 24) of the filament (13) and the associated internal current supply lead to facilitate manufacture of the weld connection.

12. The lamp of claim 1, further including a support wire (11) connected, voltage-free, to said cross bar (12) and extending up to about a central region of the filament (13).

13. The lamp of claim 1, wherein the filament (13) is a coiled-coil or double-wound filament, having end portions (15, 24), which end portions are only single-coiled or single-wound.

14. The lamp of claim 13, wherein the single-coiled end portions (15, 24) of the filament (13) are axially offset with respect to the axis of the lamp by a distance corresponding at least approximately to the radius of the secondary coiling or winding.

15. The lamp of claim 13, further including inner pin means (25, 26) inserted into the single-coiled end portions (15, 24) of the filament.

16. The lamp of claim 2, wherein the length of the trunk (17) of the T is approximately 80% to 85% of the length of the cross bar (18) of the T.

17. The lamp of claim 2, wherein the remote end (15) of the filament (13) is secured to the trunk (17) of the T.

18. The lamp of claim 1, further including an infrared reflecting coating (29) on said bulb, for reflecting heat generated upon operation of the lamp back towards the filament (13).

19. The lamp of claim 1, wherein, in top view and in a plane tranversely to the axis (A) of the lamp, said upper portion (408*a*) is essentially cruciform, having a trunk portion(417) and a cross portion (418), each of said portions having two end points;

wherein the end points of said trunk portion (417) define said first and second corner or bend points (419, 421) and the end points of said cross portion (418) define said third corner or bend point (422) and a fourth corner or bend point (424).

20. The lamp of claim 19, wherein one of the end points (419) of the trunk portion (417), at said first corner or bend point (416), is coupled to said first current supply lead (8).

21. The lamp of claim 19, further including a connecting leg portion (425;725)connecting two (421, 422) of said corner or bend points.

22. The lamp of claim 21, wherein said connecting leg portion (425) comprises an essentially straight element extending in a chord in said bulb.

23. The lamp of claim 21, wherein said connecting leg portion (725) comprises an angled element having bend portions extending, respectively, essentially parallel to part of said trunk portion (417) and part of said cross portion (418).

24. The lamp of claim 21, wherein said connecting leg portion (425, 725) connects one end point (421) which forms the second corner or bend point of the trunk portion with a first end point of the cross portion (418), and forming said third corner or bend point (422), said connecting leg portion (425, 725) forming said second connecting leg.

25. The lamp of claim 21, wherein the second end of the cross portion (418), beyond said fourth corner or bend point (424), terminates in a free end (423) of the current supply lead (408).

26. The lamp of claim 25, wherein said free end (423) is bent-over from said cross portion (418) to form a smooth corner or bend for engagement with the inner wall (14) of the bulb.

27. The lamp of claim 19, wherein the trunk portion (417) and the cross portion (418) cross each other approximately in the region of the axis (A) of the lamp.

28. The lamp of claim 19, wherein the trunk portion (417) and the cross portion (418) are of approximately equal length.

29. The lamp of claim 1, wherein said upper portion (1008*a*) of said current supply lead (1008), in plan view in a plane essentially transverse to the axis (A) of the lamp, forms, essentially, an isosceles triangle having a tip (1017*a*), one side formed by said first connecting leg (1017), a base formed by said second connecting leg (1018), and three corners, said three corners being formed by said tip (1017*a*) and two (1021, 1022) of said corner or bend points, and wherein one side of the triangle is open, and a free end (1023*a*) of said upper portion of the current supply lead is bent inwardly from said third corner and extends towards the axis (A) of the lamp.

30. The lamp of claim 29, further including a connecting leg part (1019) connecting said first corner or bend point (1016) to the tip (1017*a*) of said triangle.

31. The lamp of claim 29, wherein said triangle is an equilateral triangle and wherein the tip thereof is in engagement with the inner wall (14) of said bulb and coincides with said first corner or bend point (1216).

32. The lamp of claim 29, wherein the free end (1023*a*, 1223 has a terminal portion (1023*b*, 1223*b*) bent at right angle from the immediately preceding leg portion in the direction towards the base (5) of the lamp.

33. The lamp of claim 32, further including a straight part (1023) bent at a right angle to the inwardly bent part (1023*a*) and connecting the inwardly bent part (0123*a*) with the terminal end portion (1023*b*), and located essentially in the plane of said triangle.

34. The lamp of claim 32, wherein the remote end (1015) of the filament (13) is threaded on, and wrapped about the free end (1023*b*) of the upper portion of the first current supply lead.

35. The lamp of claim 33, wherein the remote end (1015) of the filament (13) is threaded on, and wrapped about the free end (1023*b*) of the upper portion of the first current supply lead;

and wherein said remote end (1015) of the filament is threaded over at least one of said bends in the terminal portion (1023*a*, 1023*b*) of the first current supply lead (1008).

36. The lamp of claim 1, wherein said connecting legs (17, 18; 417, 418, 425; 1017, 1018) are located, east approximately, in a single plane.

37. The lamp of claim 36, wherein said single plane extends perpendicularly to the axis (A) of the lamp.

38. The lamp of claim 36, wherein said single plane extends at an angle or inclination with respect to the axis (A) of the lamp.

39. The lamp of claim 1, wherein said first current supply lead (8) and said upper portion (8*a*) comprise a single, unitary wire element.

40. The lamp of claim 1, wherein, in plan view on a plane transverse to the axis (A) of the lamp, the corner or bend points (16, 21, 22) and said connecting legs (17, 18) define at least in part, a polygon.

41. The lamp of claim 1, wherein, in plan view on a plane transverse to the axis (A) of the lamp, the corner or bend points (16, 21, 22) and said connecting legs (17, 18) define at least in a part, a triangle.

42. The lamp of claim 1, wherein, in plan view on a plane transverse to the axis (A) of the lamp, the corner or bend points (16, 21, 22) and said connecting legs (17, 18) define, at least in part, a cross.

* * * * *

UNITED STATES PATENT AND TRADEMARK OFFICE

CERTIFICATE OF CORRECTION

PATENT NO. : 4,994,707

DATED : February 19, 1991

INVENTOR(S) : Roland STARK

It is certified that error appears in the above-identified patent and that said Letters Patent is hereby corrected as shown below:

Column 16, Claim 36, line 2:

Change "east" to --at least--.

Signed and Sealed this

Fifteenth Day of September, 1992

*Attest:*

DOUGLAS B. COMER

*Attesting Officer*

*Acting Commissioner of Patents and Trademarks*